United States Patent [19]

Rogovin

[11] 4,115,997

[45] Sep. 26, 1978

[54] TIMING ATTACHMENT FOR TELEPHONES

[76] Inventor: A. Terry Rogovin, 900 N. Lake Shore Dr., Chicago, Ill. 60611

[21] Appl. No.: 787,911

[22] Filed: Apr. 15, 1977

[51] Int. Cl.[2] ..... G04B 47/02; G04F 1/06

[52] U.S. Cl. ..... 58/144; 58/152 T

[58] Field of Search ..... 58/144, 145 K, 152 T

[56] References Cited

U.S. PATENT DOCUMENTS

| | | | |
|---|---|---|---|
| 2,078,603 | 4/1937 | Felstein et al. | 58/144 X |
| 2,765,033 | 10/1956 | Uhr | 58/144 |
| 2,941,350 | 6/1960 | Rogovin | 58/144 |
| 3,120,735 | 2/1964 | McMeans | 58/144 |

*Primary Examiner*—Stanley J. Witkowski

*Attorney, Agent, or Firm*—Silverman, Cass & Singer, Ltd.

[57] ABSTRACT

A timing attachment is secured to one side of a telephone instrument to indicate the elapsed time of a telephone conversation. The timing attachment or timer has an hourglass contained within an elongate cylinder which has an arm extending from the center thereof pivotally attached to a base member. The base is adhered to the side of the telephone instrument or other convenient surface. The cylinder and hourglass therein is rotated in a substantially vertical plane 180° at a time to allow the sand or other material to flow from one end of the hourglass to the other to measure a predetermined elapsed period of time. Various automatic indicating means cooperate with the cylinder to indicate the total number of minutes or time periods which have elapsed during a telephone conversation. The indicating means may be a rotatable cap with indicia around the periphery thereof in successive increments of the predetermined elapsed time periods corresponding to the number of times the cylinder has been rotated. The indicia may be on the cylinder visible through one or more windows in an opaque cap. The indicia may be on the male stud of the base member which are successively uncovered after each 180° rotation of the cylinder. The indicating means may include a wheel pivotally secured to the base member with actuating cogs which are engaged by at least one upright post on the cylinder.

7 Claims, 9 Drawing Figures

TIMING ATTACHMENT FOR TELEPHONES

BACKGROUND OF THE INVENTION

The invention relates to a timing attachment and more particularly to a timing attachment which is easily secured to the side of a telephone instrument or other surface close thereto for indicating the total time elapsed during telephone conversations.

SUMMARY OF THE INVENTION

The above and other disadvantages of prior art telephone timing devices and techniques are overcome in accordance with the present invention by providing a timer which may be attached to any vertical surface. The timer comprises a T-shaped cylindrical member having the hourglass in the longer arm of the T. The shorter arm extending from the cylindrical longer arm is pivotally attached to a base member and may be manually rotated about the base member. The base member has adhesive on the end thereof enabling it to be attached to the side of a telephone or any convenient substantially vertical surface so the hourglass is rotated in a substantially vertical plane. The timer has various embodiments of automatic indicators each of which include indicia indicating the total elapsed time as the timer hourglass is rotated. In one embodiment the indicator is a rotatable cap secured to one end of the long arm of the T-shaped cylinder with the indicia spaced in opposed pairs around the periphery of the cap. In another embodiment the indicia are on one end of the cylinder beneath a similar cap and visible through windows in the cap. The indicia may be on a threaded male stud secured to the base and mating with a female threaded socket in the shorter arm to expose the indicia as the hourglass is unscrewed. The indicia also may be spaced around a cogged wheel on the base which is rotated as the hourglass is rotated by one or more upright posts on the T-shaped member.

DESCRIPTION OF THE PREFERRED EMBODIMENTS

Figure 1:
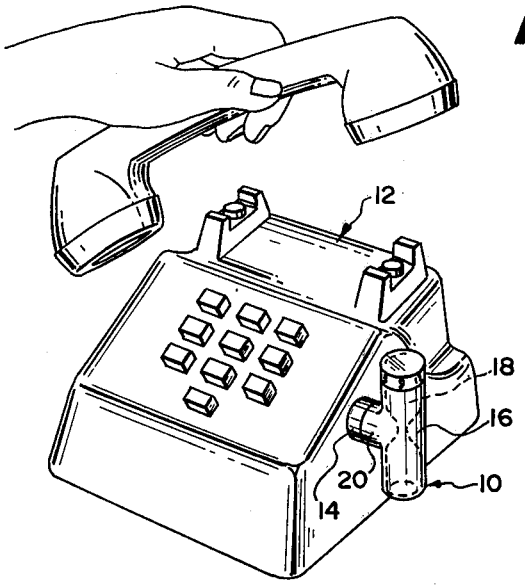
FIG. 1 is a perspective view of the timer mounted on a telephone instrument.

Referring now to FIG. 1, the timing attachment or timer of the invention is designated generally at 10 and is mounted on the side of a push-button telephone unit 12. The timer 10 is affixed to the telephone by an adhesive on the bottom of a base member 14. The adhesive may be of any convenient commercial type. The timer 10 has an elongate cylindrical member 16 which is formed unitary with or contains an hourglass 18. The cylindrical member or cylinder 16 has a pivot member 20 secured to the midpoint thereof which is pivotally secured to the base member 14. The pivot member 20 may be affixed to or molded with the cylinder 16. The pivot member 20 may be secured to the base member 14 by any convenient means such as a centrally located pin, a friction fitting or other type of pivotal arrangement which allows the cylinder 16 to be rotated in a substantially vertical plane about the base member 14 with the exertion of a small frictional force.

Figure 2:
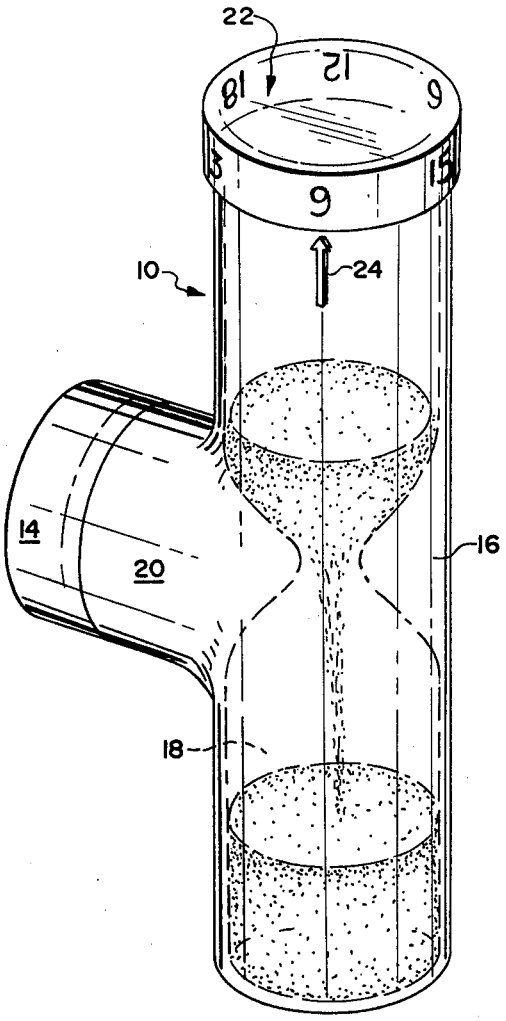
FIG. 2 is an enlarged perspective view of the timer with a cap type automatic elapsed time indicator.

Referring now to FIG. 2 the timer 10 is more clearly illustrated. The cylinder 16 and pivot member 20 will preferably be formed in a single molded tubular unit with the hourglass 18 formed as a part thereof or secured therein. The cylinder 16 is preferably made from a rigid or semi-rigid form of transparent plastic which may also form the hourglass 18 or which will form a protective shield around a standard hourglass glass 18. The hourglass 18 may be a conventional hourglass which contains a quantity of sand or like material which will flow from one end of the hourglass to the other in a predetermined period of time, such as three minutes. Thus, one rotation of the cylinder 16 and hourglass 18 will indicate an elapsed time period of three minutes when the sand or the material has drained from the top portion of the hourglass to the bottom portion of the hourglass. The sand or other material may be colored to increase visibility or the material may be a fluid containing a bubble which will also take a predetermined period of time to go from the bottom to the top of the hourglass.

One embodiment of an automatic elapsed time indicator 22 is shown secured to one end of the cylinder 16. The indicator 22 is in the form of a cap which is frictionally snap fitted over the end of the cylinder 16 which may include a circumferential groove (not shown) to mate with the lower edge of the cap to secure the cap thereon. The cylinder 16 has an arrow 24 which is directed at the elapsed time indicia which are spaced around the outter periphery of the indicator or cap 22. The time in three minute increments is displayed around the periphery of the cap and the orientation of the cap and the indicia thereon may be oriented such that the cap indicates 3 minutes, then 6 minutes, then 9 minutes or may start at zero and indicate zero then 3 minutes then 6 minutes.

In either case, the cap will be initialized or rotated to indicate the first elapsed period of time in this instance 3 minutes. When the conversation is initiated the cylinder 16 will be upside down and will be rotated to the upright position shown. The cylinder 16 and the hourglass 18 again are rotated 180° when the material in the hourglass 18 has drained to the bottom indicating the first elapsed period of 3 minutes. The indicia on the opposite side of the cylinder 16 from the arrow 24 are inverted so that when the cylinder is turned upside down with the cap 22 on the bottom thereof, the numeral six will automatically be indicated. There may be an arrow identical to the arrow 24 on the opposite side of the cylinder 16 or it may be omitted as desired. Once the material has drained again to the bottom of the hourglass 18 a time period of six minutes will have elapsed and the cylinder 16 will be rotated 180° again. Thus, the time indicator 22 automatically indicates when 3 and 6 minutes have elapsed; however, when the cap is again returned to the top first position the time indicator 22 is manually rotated so that the numeral nine is oriented above the arrow 24. The above procedure will be repeated throughout the conversation.

Figure 3:
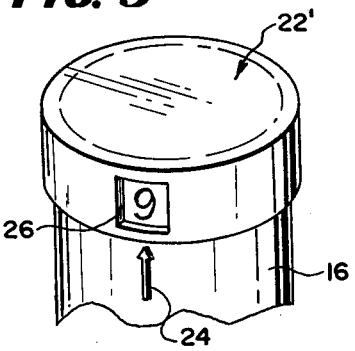
FIG. 3 is a more detailed perspective view of a second cap type elapsed time indicator.

Referring now to FIG. 3 a second embodiment of automatic time indicator 22' is illustrated. The indicator 22' is a cap like the indicator 22; however, the cap 22' preferably is opaque with the elapsed time indicia being visible through a window 26. The cap is secured to the top of the cylinder 16 as previously indicated. The indicator 22' preferably will have a second window identical to the window 26 on the opposite side of the cylinder 16 to indicate the next period of time when the cylinder is turned upside down. In this embodiment the indicia such as the numeral 9 illustrated are placed on the top end of the cylinder 16 itself rather than being placed around the periphery of the indicator as with the indicator 22.

Figure 3A:
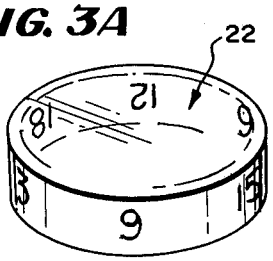
FIG. 3A is a more detailed perspective view of the elapsed time indicator of FIG. 2.

FIG. 3A shows the indicator or cap 22 removed from the top of the cylinder 16. The cap 22 is preferably transparent and preferably has at least six time periods indicated around the periphery thereof to keep track of a total of 18 elapsed minutes. There could of course be more or less time periods displayed as desired. On a lengthy telephone conversation the timer of course merely may be returned to zero and started over if the conversation extends past the total elapsed time indicated on the indicator.

Figure 4:
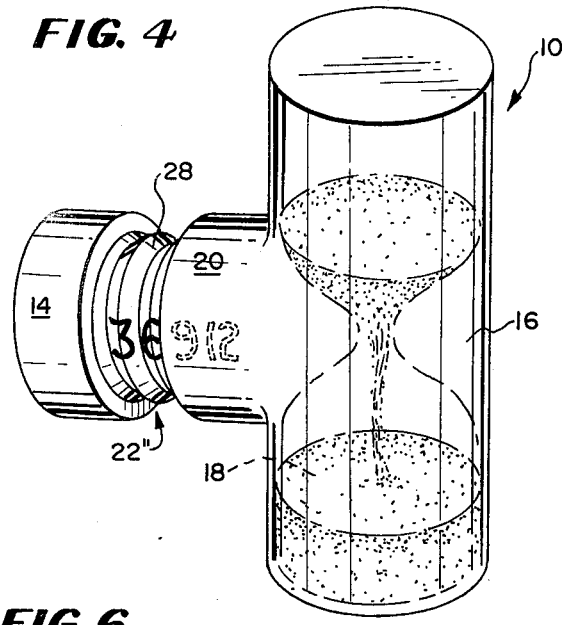
FIG. 4 is a perspective view of a screw type elapsed time indicator.

FIG. 4 illustrates an automatic screw type indicator 22''. The screw type indicator 22'' includes a male threaded stud 28 which is part of or secured to the base member 14. The elapsed time indicia are placed on one side of the stud 28 which may have a substantially flat surface with the indicia embossed or recessed thereon or otherwise permanently placed on the side of the stud 28. The pivot member 20 in this embodiment would contain a female threaded socket which would mate with the male threaded stud 28. As the timer 16 is rotated each 180° a successive elapsed time period indicia automatically appears as the pivot member 20 and cylinder 16 are unscrewed away from the base member 14. The pitch of the threads of the stud 28 may be selected to move the pivot member 20 the proper distance at each rotation.

Once the conversation is terminated or the cylinder 16 has been unscrewed to the end of the stud 28 the cylinder 16 is rotated in the reverse direction back to its compact position with the pivot member 20 against the base member 14. The orientation of the compact position with the pivot member 20 may be chosen such that the cylinder 16 does not protrude above the surface of the telephone instrument to affect the regular operation thereof with the sand or other material in one end of the hour glass ready to be rotated to the start position.

Figure 5:
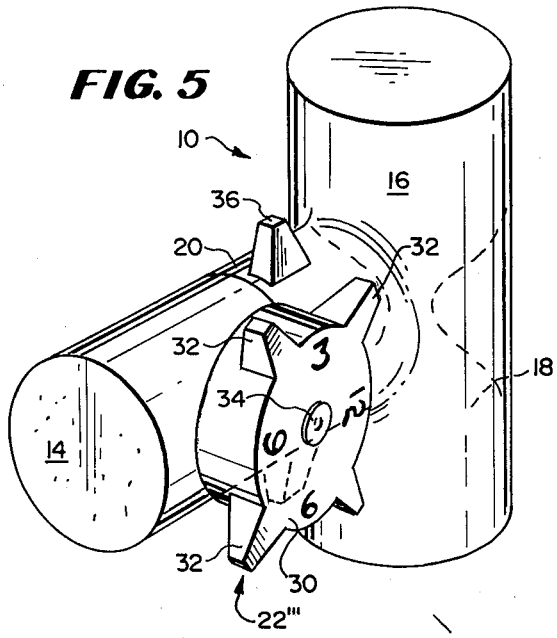
FIG. 5 and FIG. 5A are perspective views of a gear wheel type elapsed time indicator.
Figure 6:
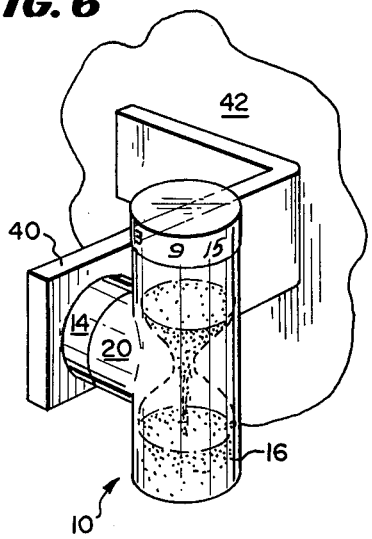
FIG. 6 is a perspective view of the timer mounted on a wall bracket.
Figure 5A:
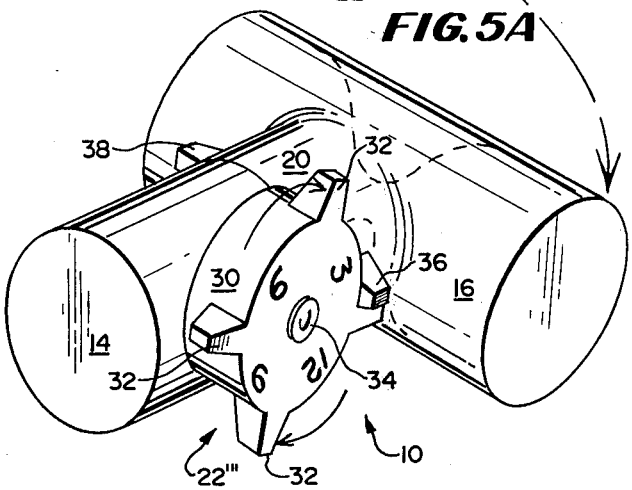

FIGS. 5 and 5A illustrate the operation of a fourth embodiment of automatic elapsed time indicator 22'''. The indicator 22''' includes a wheel 30 with a plurality of cogs 32 spaced around the periphery thereof. The wheel 30 is pivotally secured to the base member 14 by any convenient method such as a pin 34. The pivot member 20 includes at least one post 36 which mates and engages one of the cogs 32 each time the cylinder 16 is rotated 360°. In that case the indicia around the periphery of the wheel 30 would be in 6 minute intervals as the post 36 would engage one of the cogs 32 only after the cylinder was rotated 180° twice or an elapsed time period of 6 minutes.

Preferably, the pivot member 20 will include a second post 38 on the opposite side of the pivot member 20 from the post 36. In this case the post 36 will engage one of the cogs 32 when the cylinder is first rotated after the sand or other material has drained to the bottom of the hourglass 18. When the hourglass 18 and the cylinder 16 are rotated the second time the post 38 will engage the next cog 32 to rotate the wheel to the next successive indicia to allow each 3 minute time period to be automatically recorded. In this example four time periods have been illustrated; however, more or less could be designed depending on the size and spacing of the wheel 30 and the cogs 32. In this embodiment the timer does not have to be reset if the telephone conversation extends past the total number of time intervals on the wheel 30 as the wheel will automatically be rotated to the start position at that time. Again, as previously mentioned, the first indicated numeral could be zero rather than 3 minutes and of course a timer having a different predetermined elapsed time period could be utilized within the scope of the invention. The posts 36 and 38 could also extend from the side of the cylinder 16 itself.

The timer 10 may also be attached to an L-shaped bracket 40 if the user desires to have the timer 10 in a fixed location or does not desire to have the timer 10 affixed to the telephone instrument itself. The L-shaped bracket 40 is affixed to any convenient wall or office partition surface 42 by adhesive or other conventional methods. Utilization of the L-shaped bracket 40 will allow the timer 10 to be oriented in the desired position with respect to the user of the timer 10 without regard to the location of the telephone instrument itself. The bracket 40 may be made of lightweight plastic or metal or other convenient material.

Figure 6A:
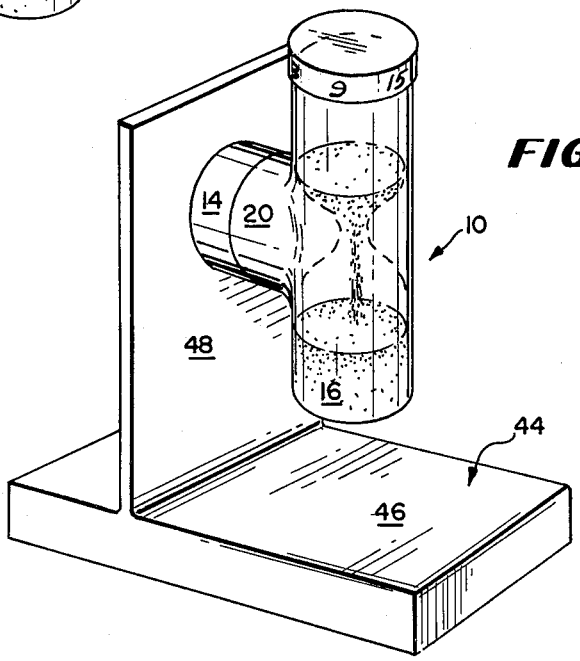
FIG. 6A is a perspective view of the timer mounted on a paperweight.

The timer 10 may also be mounted on a paperweight 44 as illustrated in FIG. 6A for utilization on a table top or desk surface or other horizontal surface or for promotional displays. The paperweight 44 includes a heavy base member 46 with an upright vertical member 48 to which the base member 14 is attached.

The base member 14, elongate member 16, and the pivot member 20 have been illustrated as being cylindrical, but of course could be of any other desired configuration. The cylinder 16 may have a flat surface on one side thereof to more easily accommodate advertising or other information or for graduations on the upper and lower portion of the cylinder 16 to indicate the actual minute by minute elapse of each three minute time period. The member 16 also may be rectangular or other shapes and the advertising also may be placed on the bracket 40 or the paperweight 44. The automatic indicator 22', 22'' or 22''' also may be utilized with the bracket 40 or the paperweight 44.

Many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A timing attachment for telephones or the like, comprising:

a base member having two ends including means at one end thereof for mounting said base member;

an elongate member including hourglass means for measuring a predetermined period of time each time said elongate member is rotated substantially 180° from a substantially vertical first position to a substantially vertical second position, said elongate member including a pivot member secured to one side thereof substantially at a midpoint thereof and pivotally attached to a second end of said base member, said elongate member including at least one substantially cylindrical end; and indicating means for automatically indicating the passage of at least one period of time when said elongate member is rotated, said automatic indicating means including a cap rotatably secured on top of said cylindrical end of said elongate member, said cap including at least one set of two successive time period indicia displayed thereon on opposite sides of said cap.

2. A timing attachment as claimed in claim 1 wherein:

said indicia are numerical characters with the second one of each set having a reversed vertical orientation to the first one of each set.

3. A timing attachment for telephones or the like, comprising:

a base member having two ends including means at one end thereof for mounting said base member;

an elongate member including hourglass means for measuring a predetermined period of time each time said elongate member is rotated substantially 180° from a substantially vertical first position to a substantially vertical second position, said elongate member including a pivot member secured to one side thereof substantially at a midpoint thereof and pivotally attached to a second end of said base member;

said elongate member including at least one cylindrical end, with at least one set of two successive time period indicia displayed on opposite sides of the cylindrical end of said elongate member; and indicating means for automatically indicating the passage of at least one period of time when said elongate member is rotated, said indicating means including a cap rotatably secured over the cylindrical end of said member covering said indicia including a window in at least a first side of said cap for displaying a first one of said indicia.

4. A timing attachment as claimed in claim 3 wherein:

said indicia are numerical characters with the second one of each set having a reversed vertical orientation to the first one of each set; and said cap means including a second window opposite said first window for displaying the second one of each set of indicia.

5. A timing attachment for telephones or the like, comprising:

a base member having two ends including means at one end thereof for mounting said base member an elongate member including hourglass means for measuring a predetermined period of time each time said elongate member is rotated substantially 180° from a substantially vertical first position to a substantially vertical second position, said elongate member including a pivot member secured to one side thereof substantially at a midpoint thereof and pivotally attached to a second end of said base member;

indicating means for automatically indicating the passage of at least one period of time when said elongate member is rotated; and said indicating means including a male threaded stud secured to the end of said base member, a female threaded socket in said pivot member mated with and engaged on said stud, and said stud including a set of indicia which successively display the elapsed time period as said elongate member is unscrewed away from said base member.

6. A timing attachment for telephones or the like, comprising:

a base member having two ends including means at one end thereof for mounting said base member;

an elongate member including hourglass means for measuring a predetermined period of time each time said elongate member is rotated substantially 180° from a substantially vertical first position to a substantially vertical second position, said elongate member including a pivot member secured to one side thereof substantially at a midpoint thereof and pivotally attached to a second end of said base member;

indicating means for automatically indicating the passage of at least one period of time when said elongate member is rotated; and said indicating means including a rotatable wheel secured to one side of said base member, including gear means spaced around the periphery of said wheel and indicia indicative of the elapsed periods of time spaced around said wheel and at least one post means secured to said elongate member to engage with said gear means of said wheel to rotate said wheel a portion of a revolution at least once each time said elongate member is rotated 360°.

7. A timing attachment as claimed in claim 6 wherein:

said gear means include a multiple number of cogs extending from said wheel; and said post means include a first post on one side of said pivot member substantially parallel with said elongate member and a second post on the opposite side of said pivot member to rotate said wheel a portion of a revolution each time said elongate member is rotated 180°.

* * * * *